United States Patent [19]

Mehta

[11] Patent Number: 4,608,771

[45] Date of Patent: Sep. 2, 1986

[54] ANIMATED HEART NOVELTY DISPLAY

[76] Inventor: Satish Mehta, 3136 Deluna Dr., Rancho Palos Verdes, Calif. 90274

[21] Appl. No.: 696,339

[22] Filed: Jan. 30, 1985

[51] Int. Cl.[4] ..... G09F 19/12

[52] U.S. Cl. ..... 40/427; 272/8 D; 40/538; 40/411

[58] Field of Search ..... 40/1.5, 427, 411, 429, 40/538; 63/31; 446/295; 278/8 N, 8; 434/265, 267, 272, 275; 128/25 B

[56] References Cited

U.S. PATENT DOCUMENTS

| | | | |
|---|---|---|---|
| 1,763,467 | 6/1930 | Klinker | 272/8 N |
| 2,425,965 | 8/1947 | Sundheim | 272/8 N |
| 2,887,818 | 5/1959 | Zalkind | 272/8 N |
| 4,055,014 | 10/1977 | Schmidt et al. | 40/442 |
| 4,263,743 | 4/1981 | Hanson et al. | 40/411 |

*Primary Examiner*—Gene Mancene
*Assistant Examiner*—Werceslao J. Contreras
*Attorney, Agent, or Firm*—Robert J. Schaap

[57] ABSTRACT

An emotional gift device in the stylized representation of a human heart and which comprises a container having a three dimensional stylized human heart representation located therein. A motor which is not visable to the viewer operates a drive shaft which, in turn, rotates a cam upon actuation of a switch. The rotation of the cam causes the stylized representation of a human heart to oscillate in a manner similar to the pumping action of a human heart.

22 Claims, 9 Drawing Figures

ANIMATED HEART NOVELTY DISPLAY

BACKGROUND OF THE INVENTION

1. Field of the Invention

This invention relates in general to certain new and useful improvements in gift or greeting devices and more particularly, to gift or greeting devices having a three dimensional stylized representation of a human heart which are capable of moving in an action to represent the palpatating action of a human heart.

2. Brief Description of the Prior Art

The give and greeting card industry has made very few notable changes for a long period of time. In essence, most greetings, particularly with those designed to create emotional effects, are made with greeting cards containing pre-printed messages thereon. Moreover, the greeting card may be accompanied by a gift which may be personal to the recipient.

In recent years, greeting card manufacturers have attempted to include some small device as for example, a stylized representation of a human heart and which may have a thickness slightly greater than the thickness of the paper forming part of the greeting card. However, essentially all greeting cards have little or no self-powered action to simulate a known effect.

There have been various proposed and commercially available greeting and gift devices which contain a three dimensional representation of a human heart. However, these three dimensional representations of a human heart or for that matter, any other organ, are static in that they generally remain in a box or similar enclosure and are not active in a manner in which the activity conveys a message.

More specifically, there has been no greeting device in the nature of a human heart which presents a connotation of love and which is capable of a dynamic action to further enhance that emotional effect.

OBJECTS OF THE INVENTION

It is, therefore, one of the primary objects of the present invention to provide a gift or greeting device which contains a stylized representation of a human heart and which representation of the human heart is capable of movement in a manner to simulate the moving action of an actual human heart.

It is another object of the present invention to provide a gift or greeting device of the type stated in which an electrical motor powered by a source of stored electrical energy can cause operation of the stylized representation of the human heart in the manner to simulate a pumping action of a human heart.

It is a further object of the present invention to provide a gift or greeting device of the type stated which can obviate the need for a separate gift to accompany a greeting card.

It is an additional object of the present invention to provide a gift or greeting device of the type stated which includes the stylized representation of a human heart located inside of a container with a closeable and openable lid on that container and which lid may also contain a static stylized representation of a human heart.

It is another salient object of the present invention to provide a gift or greeting device of the type stated which can be manufactured at a relatively low cost, but which is highly effective in conveying a message of love or closeness.

It is also an object of the present invention to provide a dynamic gift or greeting device which is capable of generating an activity representative of affection and love and which also functions as a greeting or decorative device.

With the above and other objects in view, my invention resides in the novel features and forms, construction, arrangement and combination of parts presently described and pointed out in the claims.

BRIEF SUMMARY OF THE DISCLOSURE

The invention relates in general to an emotional gift and decorative device or otherwise a greeting device which has the stylized representation of a human heart to provide a connotation of movement thereof. In one embodiment, the gift or greeting device comprises a container having an interior section with a three dimensional representation of a human heart located therein. This representation of a human heart has approximately the size and shape of a stylized human heart such that when moving, it would appear as though there was a pulsating or pumping movement of a human heart.

The device of the present invention also comprises a motive means which may be in the form of a small electrical motor and which is hidden from view when the container is opened. This electrical motor may be operated by a source of stored electrical energy, as for example, one or more dry-cell batteries. A drive means is connected to the motive means and extends into the stylized representation of the human heart in order to cause an oscillatory movement of this stylized representation of the human heart. This oscillatory movement preferably takes the form of an up and down movement to represent a pulsating action or a pumping action of a normal human heart.

In another embodiment of the invention, a separate switch means is employed so that the user may actuate the switch to start and stop the pumping action. If desired, the switch could be incorporated as part of a hinge mechanism or could be located so as to be operable upon a mere opening or closing of the container. In this latter embodiment, the opening of the lid on the container would actuate the switch to start the oscillatory movement and hence the representation of the pumping action of the human heart.

In a more preferred embodiment, the motive means comprises a drive shaft which extends from the electric motor and into the representation of the human heart. In this case, the representation of the human heart would be visible, although the drive shaft and the motive means would not be normally visible to the viewer of the device. Moreover, the motive means would comprise a camming member located on the motive means and which rotates in response to energization of the motive means. In this way, the camming member will provide an effective camming action, which will, in turn, cause the oscillatory movement of the stylized representation of the human heart.

This invention possesses many other advantages and has other purposes which may be made more clearly apparent from a consideration of forms in which it may be embodied. These forms are shown in the drawings accompanying and forming part of the present specification. They will now be described in detail, for the purposes of illustrating the general principles of the invention; but it is to be understood that such detailed descriptions are not to be taken in a limiting sense.

BRIEF DESCRIPTION OF THE DRAWINGS

Figure 1:
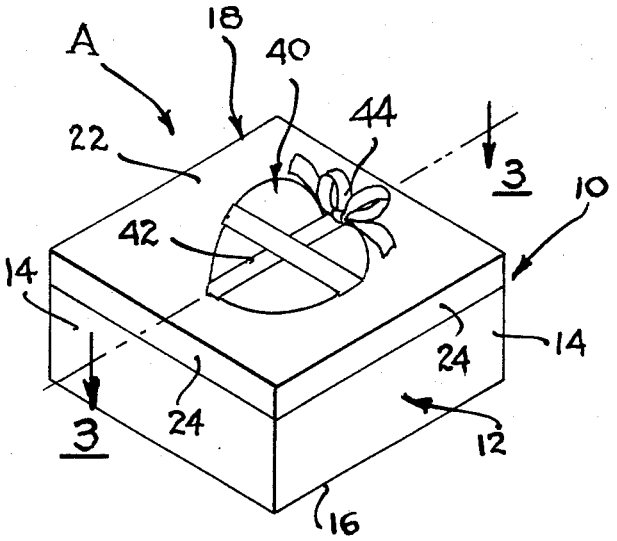
Figure 2:
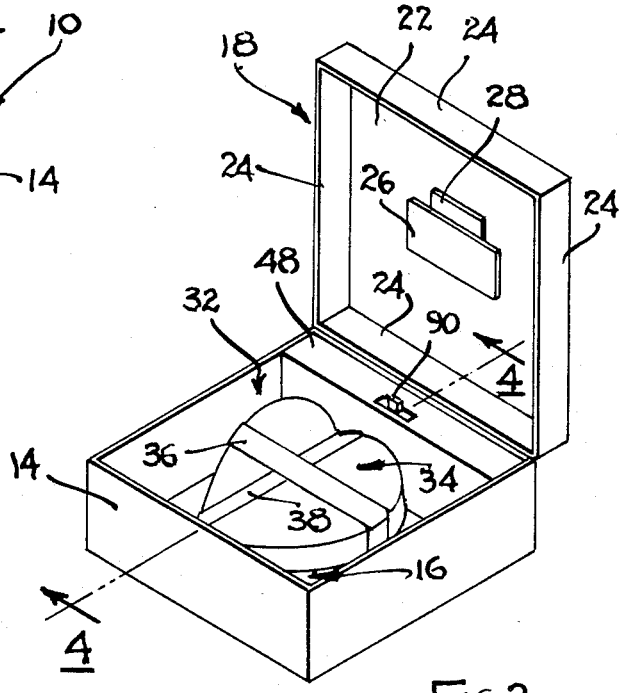
Figure 3:
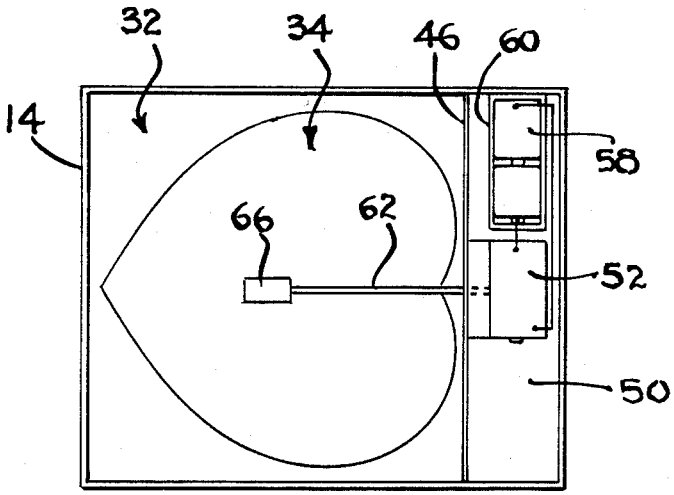
Figure 4:
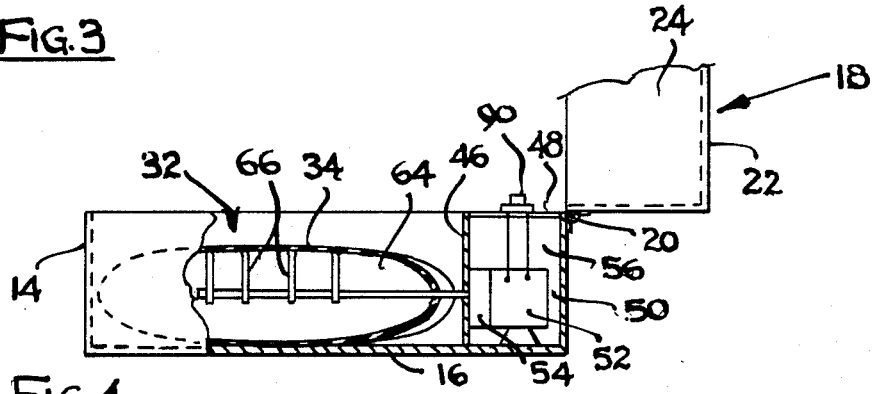
Figure 5:
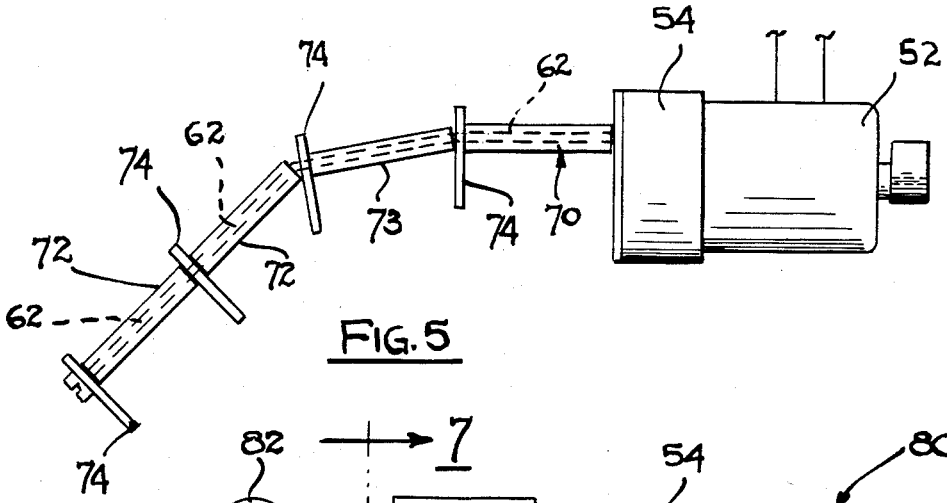
Figure 7:
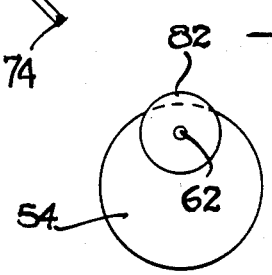
Figure 6:
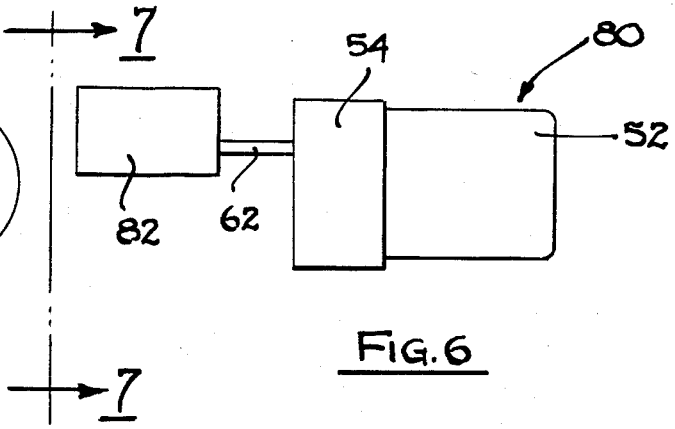
Figure 8:
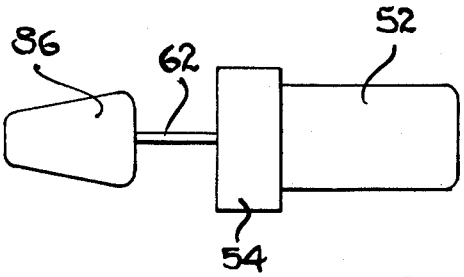
Figure 9:
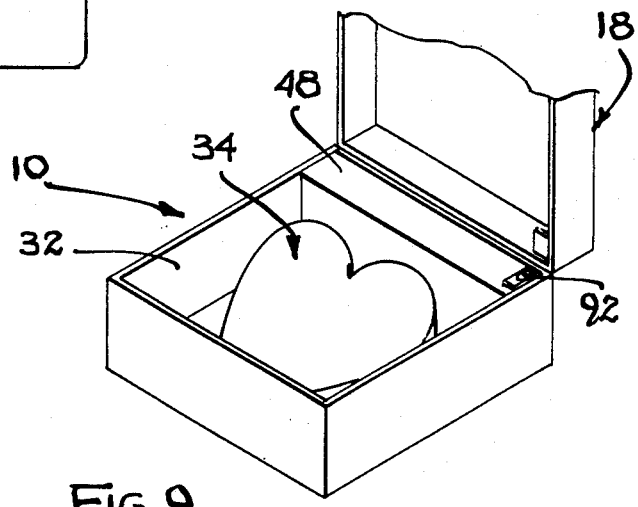

Having thus described the invention in general terms, reference will now be made to the accompanying drawings (two sheets) in which:

FIG. 1 is a perspective a view of a gift or greeting device constructed in accordance with the present invention;

FIG. 2 is a perspective view of the gift or greeting device of the present invention, similar to FIG. 1, and showing the container forming a part thereof in the opened condition;

FIG. 3 is a horizontal sectional view taken along line 3—3 of FIG. 1 and showing the interior portion of the container forming part of the gift or greeting device of the present invention;

FIG. 4 is a vertical sectional view taken along line 4—4 of FIG. 2;

FIG. 5 is a side elevational view showing the motive means and drive means forming part of the device of the present invention;

FIG. 6 is a top plan view of the motive means and drive means of FIG. 5;

FIG. 7 is an end elevational view taken substantially along the plane of line 7—7 of FIG. 6;

FIG. 8 is a fragmentary side elevational view of a modified form of the gift or greeting device of the present invention; and FIG. 9 is a perspective view, similar to FIG. 2 and showing yet another embodiment of the switch mechanism forming part of the device of the present invention.

DETAILED DESCRIPTION OF PREFERRED EMBODIMENTS

Referring now in more detail and by reference characters to the drawings which illustrate practical embodiments of the present invention, A designates a gift or greeting device in the nature of a stylized representation of a human heart as hereinafter described in more detail. This device A may adopt either the form of a gift or of a greeting device or for that matter, it may also be a decorative device. Thus, the term gift device or greeting device is deemed to include a decorative device as well.

The gift or greeting device A generally comprises a box-like container 10 having a container base section 12 which is generally rectangular in shape. The base container section 12 is comprised of an enclosing side wall 14 closed at its lower edge by a bottom wall 16. Hingedly mounted to a rearward edge of the enclosing side wall 14 is a lid 18 and which is connected to the rearward upper edge of the enclosing side wall 14 by means of one or more hinges 20. In this way, the lid 18 is capable of being hingedly shiftable from a position where it is disposed over the base container section 12, as illustrated in FIG. 1, to a position where is is opened with respect to the base container section 12, in the manner as illustrated in FIGS. 2 and 4 of the drawings.

In the embodiment as illustrated, the lid 18 is rectangularly shaped and includes a top wall 22 with a peripherally extending continuous and rectangularly shaped side wall 24 which is adapted to engage the upper edge of the enclosing side wall 14.

The interior surface of the top wall 22 forming part of the cover 18 is provided with an envelope section or so-called "pocket" 26 which is adapted to receive a message card or similar element which may have a message written thereon by the sender as for example, a message card 28 as shown. In addition, the interior surface of the top wall 22 could also be provided with written messages or the like to be read by the recipient of the gift or greeting device.

The enclosing side wall 14 and the bottom wall 16 together form an interior compartment 32 within the base container section, as best illustrated in FIGS. 2–4 of the drawings. Located within the interior compartment 32 is an object 34 which is a stylized representation of a human heart and which object is three dimensional in nature. Moreover, the object 34 substantially fills the entire interior compartment 32.

The object 34, which is in the nature of a stylized representation of a stylized human heart, has a size and shape approximating that of a human heart. In this respect, the container 10 is sized so that it can receive an object 34 having a size approximating that of a human heart. In other embodiments, the size of the container 10 as well as the size of the object 34 can be reduced proportionally. Nevertheless, the shape of the object 34 is that which is approximate to a stylized human heart. The stylized representation of a human heart is formed of a material which may have a skin-like feel. Moreover, while the human heart itself may be slightly grey in color, the representation of the heart would have a slightly greater amount of red pigment therein in order to provide a representation of a heart in a color which is commonly understood by many people to be associated with the human heart. The representation of the human heart is referred to as "stylized" since the common heart shape, associated with e.g. valentines, may not adopt the true shape of a human heart.

The object 34 may be secured to the upper surface of the bottom wall 16 by any conventional means, as for example, by a conventional adhesive. Other means for retaining the object 34 within the interior compartment 32 may also be employed.

The object 34 which is the stylized representation of a human heart, as aforesaid, may also have ribbon strips 36 wrapped thereabout and which may also include a bow 38 much in the nature of a gift wrapped present. Moreover, this stylized representation of the the human heart 34 substantially fills the entire container 32, in the manner as more fully illustrated in FIG. 2 of the drawings.

Also mounted on the exterior surface of the cover 18, that is, on the upper surface of the top wall 22, is another three dimensional stylized representation of a human heart 40. This stylized representation of the human heart 40 may also be secured to the upper surface by means of an adhesive or other suitable fastening means. This representation of the human heart 40 does not necessarily have to have a skin-like feel and appearance, although it may be formed of many suitable materials. Moreover, this object 40, which is in the nature of a stylized representation of a human heart, may also have ribbon strips 42 and a bow 44 thereon, much in the same manner as the object 34 in the interior compartment 32.

The interior compartment 32 is provided with a vertically disposed rearwardly located wall 46 and a horizontally disposed wall 48 which together with a portion of the enclosing side wall 14 and the bottom wall 16 form a drive motor chamber 50, in the manner as more fully illustrated in FIGS. 3 and 4 of the drawings. Located within the chamber 50 is small electric motor 52 having a gear box 54 on the output portion thereof. This motor 52 may be retained in the chamber 50 by any suitable means, as for example, a bracket 56 in the manner as illustrated.

The electrical motor 52 is of a generally conventional construction and may be powered by means of any suitable source of stored electrical energy, as for example, electric batteries 58 which are retained in a battery storage rack 60, the latter also being mounted on the bottom wall 16 in the chamber 50.

The upper wall 48 may be hingedly mounted or otherwise removable in order to provide access to the interior motor chamber 50. Otherwise, other portions of the container may be removable in order to provide access to interior motor compartment for the purposes of servicing and/or changing the batteries 58, as may be required.

The electric motor 52 as well as a source of stored electrical energy, such as the batteries 58, form part of a drive means which is provided to cause movement of the object 34. This drive means is generally hidden from sight of the viewer and may include a somewhat deflectable drive shaft 62 which extends outwardly from the motor chamber 50 through the vertically disposed wall 46 and into the object 34 in the nature of a representation of a human heart. In this respect, and by reference to FIGS. 3 and 4, it can be observed that the object 34 is sufficiently closely spaced to vertically disposed wall 46 so as to receive the drive shaft 62 in a manner so that it is not readily visible to a receiver or user of the device.

By further reference to FIGS. 3 and 4, it can be observed that the drive shaft extends interiorly into the object which is the representation of a human heart. Moreover, this object is generally solid except for an interior chamber 64 which is closely spaced to and sized to receive the drive shaft 62 and a camming means 66 on an end thereof, in the manner as illustrated in FIGS. 3 and 4. This camming means is hereinafter described in more detail. However, the camming means serves to provide the oscillatory movement of the object 34 in response to energization of the motor 52 and rotation of the drive shaft 62. In this respect, the chamber 64 is sufficiently small so that the camming means 66 literally engages portions of the interior surface of this chamber to cause an oscillatory movement of the object. It should also be understood that the object is formed of a rubber-like or elastic material so as to be movable and oscillatable in response to rotation of the drive shaft 62 and rotation of the camming means 66.

One embodiment of a drive section forming part of the device of the present invention is more fully illustrated in FIG. 5 of the drawings. In this embodiment, the drive shaft 62 includes a linearly extending section 70 as well as an arcuately located section 72 out of the axis of the linear section 70 each of the drive shaft sections 70 and 72 are covered by sleeves 73. Moreover, a plurality of camming discs 74 are mounted between the linear section 70 and on the arcuately shaped section 72. In actual construction, the drive shaft is somewhat bendable or deflectable so as to create the arcuately shaped section. The camming discs 74 are mounted so that they may be either eccentric or concentric with respect to the axis of the drive shaft 62. In any event, when the motor 52 is energized, the drive shaft 62 will be rotated so that at least the arcuate section 72 is rotated to cause the camming discs 74 located thereon to cause a greater oscillatory movement of that portion of the object than the camming disc 74 located at the end of the linear section 70.

FIGS. 6 and 7 illustrate a more preferred embodiment of the invention which utilizes a drive mechanism 80. This drive mechanism 80 comprises the motor 52 and gear reducer 54 along with a drive shaft 62. Further, and in accordance with this embodiment, an enlarged cam 82 is mounted on an outer end of the drive shaft 62 and is eccentrically located with respect to the drive shaft 62. In this way, when the drive shaft 62 is rotated, in response to energization of the motor 52, the cam 82 will move in an oscillatory path. This will cause an oscillatory movement of the object 34 in the representation of a human heart. Moreover, the cam can be shaped and located relative to the object such that the oscillatory movement closely approximates that of the pumping action of a human heart.

In the embodiment of the invention as illustrated in FIGS. 6 and 7, it can also be observed that the camming means 82 is in the form of an elongate cylinder, as opposed to a plurality of individually thin-sliced spaced discs in the embodiment shown in FIG. 5. Moreover, while the outer contour of the cam 82 is shown as being somewhat regular in shape, it should be understood that the outer contour of this cam could be irregular in shape so as to provide a cam 86 illustrated in FIG. 8 as an alternate embodiment of the present invention. In essence, the device as illustrated in FIG. 8 is similar to the device in FIGS. 6 and 7, except that the cam 86 has a shape so as to conform approximtely to a stylized representation of a human heart.

The device of the present invention is also provided with a manually operable user actuable switch 90 located on the horizontally disposed wall 48 in the previously described embodiments of the invention. Thus, when the user opens the cover 18, the user can shift the manually operable portion of the switch 90 to cause energization of the motor or de-energization of the motor.

FIG. 9 illustrates an embodiment of the invention in which a switch 92 is located to be actuated by opening and closing movement of the cover 18. In this embodiment, the switch 92 is located so as to be engaged by a closing action of the cover 18 which will cause a de-energization of the motor 52. In like manner, upon opening of the cover 18, the switch 92 will be automatically actuated to cause an energization of the motor 52 and hence an oscillatory action of the object 34 which is the representation of the human heart.

The outer container 10 has been illustrated as being rectangular in shape. However, it should be understood that this outer container could adopt various shapes in accordance with the present invention. For example, and in still another preferred embodiment, the outer container itself could be in the form of a heart shape.

The outer container may be formed of a number of well known structural materials, as for example, paperboard, cardboard, plastics or reinforced plastic materials, etc. In a more preferred embodiment, the outer container is formed of a cardboard-like reinforced material. The object representative of a human heart is formed of a somewhat rubber-like or elastic material which is expandable and is sufficiently yieldable so as to create a movement depicting that of a human heart in response to rotation of the camming means heretofore described.

The gift or greeting device of the invention is designed to create a highly emotional effect which is not otherwise capable of being generated by conventional gifts or greeting cards or combinations thereof. When the receiver or user of this gift or greeting device opens the container, he or she immediately views a three dimensional stylized representation of a human heart which initially presents a connotation of love or close and warm feelings. However, when the user actuates the switch, the three dimensional representation of the heart immediately starts an oscillatory action which is similar to that of the pumping action of a human heart. Thus, the viewer receives an impression of a human heart located in the box as a gift from the sender. In effect, the recipient is perceived to have received the heart of the sender.

There is a clear and noticeable effect when the heart starts a beating action. This effect is significantly greater than that which can be otherwise achieved by a mere greeting card even when accompanied by a gift. The device, while simple, nevertheless does create a very substantial emotional effect and thus, is highly effective as a gift or a decorative device or greeting device, particularly when it is desired to convey feelings of love or warm affections.

The effect of the beating heart is even further enhanced when the embodiment of the invention utilizes the switch which is automatically actuable upon opening of the lid. In this way, and for at least the first time, the receiver does not know the effect which will be created upon the opening of the lid. This not only has a surprise effect, but the very warm generation of feelings as well.

Thus there has been illustrated and described a unique and novel gift and greeting device which is capable of providing a dynamic action and more specifically, is capable of providing an action representing the movement of a human heart. Thus, the present invention fulfills all of the objects and advantages which have been sought. It should be understood that many changes, modifications, variations, and other uses and applications will become apparent to those skilled in the art after considering the specification and the accompanying drawings. Therefore, any and all such changes, modifications, variations and other uses and applications which do not depart from the spirit and scope of the invention are deemed to be covered by the invention which is limited only by the following claims.

Having thus described my invention, what I desire to claim and secure by Letters Patents is:

1. An emotional gift and decorative device in the stylized representation of a human heart to provide a connotation of a movement thereof, said device comprising:

(a) a container having a container section with a three dimensional representation of a human heart therein and which has an interior chamber and an exterior surface which is capable of being shifted outwardly and inwardly with respect to the remaining portion of the representation of the human heart to provide a pulsating action, and which representation of the human heart has a configuration and approximate size and shape of a stylized human heart such that when pulsating it would appear as a representation of a beating human heart, (b) a source of stored electrical energy located within said container, (c) motive means operatively connected to said source of stored electrical energy and being powered thereby, and (d) means connected to said motive means and extending into said interior chamber of said representation of the human heart to cause the exterior surface to be moved inwardly and outwardly thereby in a cyclic pattern in response to energization of said motive means to simulate a beating movement of a human heart.

2. The device of claim 1 further characterized in that switch means is connected to said motive means to connect and disconnect the motive means from and to the source of stored electrical energy.

3. The device of claim 1 further characterized in that said container section has an interior compartment with said three dimensional representation of said heart therein, and a lid which is openable and closeable with respect to said interior compartment.

4. The device of claim 2 further characterized in that said motive means is an electric motor powered by said source of stored electrical energy.

5. The device of claim 4 further characterized in that said source of stored electrical energy is at least one storage battery.

6. The device of claim 1 further characterized in that means connected to said motive means and extending into the interior chamber of the representation of the human heart is a drive shaft with a camming means disposed in said chamber of the representation of the heart and operable by said drive shaft.

7. The device of claim 6 further characterized in that said camming means is located on said drive shaft near an end thereof and is oscillated in response to rotation of said drive shaft.

8. The device of claim 7 further characterized in that said drive shaft is a linearly extending drive shaft and said camming means is a cam eccentrically mounted on said drive shaft.

9. The device of claim 8 further characterized in that said camming means comprises a plurality of spaced apart cams eccentrically mounted on said drive shaft.

10. The device of claim 7 further characterized int that said drive shaft has a section which is angularly located with respect to another section and extends into the interior chamber of the representation of the heart and has a plurality of cams mounted thereon to cause oscillatory movement of the exterior surface of the representation of the heart in response to oscillatory movement of the drive shaft.

11. The device of claim 1 further characterized in that a lid is on said container section and is openable and closeable with respect to the container section and stylized representation of the heart.

12. The device of claim 11 further characterized in that the representation of the heart is a three dimensional object having a size and shape approximating that of a human heart.

13. A dynamic gift and decorative device which is powered for movement, said device comprising:

(a) a container having a container section with a three dimensional stylized representation of a human organ therein, and which has an interior chamber and an exterior surface portion capable of being moved with respect to a remaining portion to depict a movement thereof, (b) a source of stored electrical energy located within said container, (c) motive means connected to said source of stored electrical energy and being powered thereby, (d) a drive shaft connected to said motive means and extending into the interior chamber of said representation of the human organ, (e) a camming means disposed in said interior chamber of the representation of the human organ and operable by said drive shaft to cause said exterior surface portion to be moved inwardly and outwardly thereby in a cyclic pattern in response to energization of said motive means to simulate movement of the human organ.

14. The device of claim 13 further characterized in that said container section has an interior compartment with said three dimensional representation of said organ therein, and a lid which is openable and closeable with respect to said interior compartment.

15. The device of claim 14 further characterized in that said motive means is an electrical motor powered by said source of stored electrical energy.

16. The device of claim 15 further characterized in that said source of stored electrical energy is at least one storage battery.

17. The device of claim 13 further characterized in that said camming means is located on said drive shaft near an end thereof and is oscillated in response to rotation of said drive shaft.

18. The device of claim 17 further characterized in that said drive shaft is a linearly extending drive shaft and said camming menas is a cam eccentrically mounte on said drive shaft.

19. The device of claim 18 further characterized in that the stylized representation of a human organ is a representation of a human heart having a configuration and approximate size and shape of a human heart such that when pulsating it would appear as a human heart.

20. An emotional gift and decorative device in the stylized representation of a human heart to provide a connotation of a movement thereof, said device comprising:

(a) a container having a container section with a three dimensional representation of a human heart therein and which has an interior chamber and an exterior surface which is capable of being shifted outwardly and inwardly with respect to the remaining portion of the representation of the human heart to provide a pulsating action, and which representation of the human heart has a configuration and approximate size and shape of a stylized human heart such that when pulsating it would appear as a representation of a beating human heart, (b) a source of stored electrical energy located within said container, (c) motive means operatively connected to said source of stored electrical energy and being powered thereby, and (d) a drive shaft connected to said motive means and extending into said interior chamber of said representation of the human heart, and (e) at least one element operatively engagable with said drive shaft in said interior chamber and having an operative engagement with the interior surface forming said chamber, to cause the exterior surface to be moved inwardly and outwardly thereby in a cyclic pattern in response to energization of said motive means to simulate a beating movement of a human heart.

21. The device of claim 20 further characterized in that said element is a cam mounted on said drive shaft in said interior chamber bearing against said interior surface to cause the movement of a cyclic pattern.

22. An emotional gift and decorative device in the stylized representation of a human heart to provide a connotation of a movement thereof, said device comprising:

(a) a container having a container section with a three dimensional representation of a human heart therein and having a front surface and where substantially the full front surface is capable of being shifted outwardly and inwardly with respect to another portion of the representation of the human heart to provide a pulsating action, and which representation of the human heart has a configuration and approximate size and shape of a stylized human heart such that when pulsating it would appear as and simulate a representation of a beating human heart, (b) a source of stored electrical energy located within said container, (c) motive means powered by said source of stored electrical energy and being powered thereby, and (d) means connected to said motive means and extending into said representation of the human heart to cause the front surface to be moved thereby in a cyclic pattern in response to energization of said motive means to simulate a beating movement of a human heart.

* * * * *